US006453819B1

(12) United States Patent
Coates

(10) Patent No.: US 6,453,819 B1
(45) Date of Patent: Sep. 24, 2002

(54) PAINT BALL GRENADE

(76) Inventor: Paul R. Coates, 72 Christina St., Little Ferry, NJ (US) 07643

( * ) Notice: Subject to any disclaimer, the term of this patent is extended or adjusted under 35 U.S.C. 154(b) by 0 days.

(21) Appl. No.: 09/707,039

(22) Filed: Nov. 6, 2000

(51) Int. Cl.[7] ..... F42B 8/12; F42B 12/36

(52) U.S. Cl. ..... 102/498; 102/502; 102/513; 446/401; 446/473; 446/577

(58) Field of Search ..... 102/383, 395, 102/480, 482, 498, 502, 513, 529; 446/400, 401, 473; 473/577; 124/59, 73–77; 434/11

(56) References Cited

U.S. PATENT DOCUMENTS

| | | | | |
|---|---|---|---|---|
| 4,932,329 A | | 6/1990 | Logie | 102/498 |
| 4,944,521 A | | 7/1990 | Greeno | 102/498 |
| 5,018,449 A | | 5/1991 | Eidson, II | 102/498 |
| 5,590,886 A | | 1/1997 | Lush | 102/498 |
| 5,877,448 A | | 3/1999 | Denton et al. | 102/498 |
| 5,996,503 A | | 12/1999 | Woodall et al. | 102/498 |
| 6,065,404 A | | 5/2000 | Rippingill, Jr. et al. | 102/498 |
| 6,311,681 B1 | * | 11/2001 | Snyder, Jr. | 124/59 |

* cited by examiner

*Primary Examiner*—Harold J. Tudor
(74) *Attorney, Agent, or Firm*—Richard M. Goldberg

(57) ABSTRACT

A paint ball grenade includes a base having a chamber for holding a compressed gas, an outer housing mounted on the base, the outer housing including guides through which fluid communication is provided between an interior and exterior of the outer housing, each guide releasably holding a paint ball, a valve arrangement for blocking fluid communication between the chamber and the interior of the housing in a first position and for permitting fluid communication between the chamber and the interior of the housing in a second position, an actuator for opening the valve arrangement to provide fluid communication between the chamber and the interior of the housing to eject the paint balls from the guides, and a reed valve separately associated with each guide for substantially preventing further supply of the compressed gas through each guide after the paint ball therein has been ejected.

24 Claims, 4 Drawing Sheets

PAINT BALL GRENADE

BACKGROUND OF THE INVENTION

The present invention relates generally to the paint ball shooting devices, and more particularly, is directed to a paint ball grenade that can simultaneously shoot a plurality of paint balls.

In the game of paint ball, each person has a gun that shoots tiny balls of paint at another person. When a paint ball impacts, the paint from the paint ball splatters against the person who is shot. However, in many times, a person would like to hit multiple people with paint balls at the same time. This may happen, for example, when a person is in close proximity to multiple players from an opposing team. However, this is extremely difficult with a single paint ball gun.

Although the concept of providing multiple projectiles from a grenade is known from U.S. Pat. Nos. 4,944,521; 5,877,448; and 5,996,503, these devices rely on a mechanical pin being pulled and/or a lever operated in order to rupture a compressed gas cylinder in the interior of the grenade so that the compressed gas from the cylinder operates to eject the paint balls. Various ones of these devices also provide a delayed firing arrangement. For example, U.S. Pat. No. 4,944,521 discloses the use of plugs in the passages leading to the paint balls to provide a delay in the firing of the paint balls from the release of the compressed gas. This, however, relies on the friction of the plugs in the passages, which can vary, and therefore, the delay time can be difficult to gauge. U.S. Pat. No. 5,996,503 uses a plunger connected with the handle lever to provide the delay. However, this device relies on suction of the plunger, which will vary depending upon such conditions as temperature, humidity, etc., and is therefore not very reliable.

In addition, with all of these devices, if one paint ball is ejected prior to the others, there will be much less resistance in the passageway leading to that paint ball. As a result, the compressed gas will travel along the path of least resistance, namely, the passageway corresponding to the first paint ball that had been fired. Accordingly, the other paint balls may not be fired.

OBJECTS AND SUMMARY OF THE INVENTION

Accordingly, it is an object of the present invention to provide a paint ball grenade that overcomes the problems with the aforementioned prior art.

It is another object of the present invention to provide a paint ball grenade which will simultaneously shoot a plurality of paint balls.

It is still another object of the present invention to provide a paint ball grenade that has a timer mechanism in order to delay firing and give the person activating the grenade time to retreat.

It is yet another object of the present invention to provide a paint ball grenade that can be remotely detonated.

It is a further object of the present invention to provide a paint ball grenade that does not require a separate canister of compressed gas inside the device, but rather, provides a rechargeable base, along with a valve arrangement which can be opened to permit the compressed gas to flow through and eject the paint balls.

It is a still further object of the present invention to provide a paint ball grenade which uses a chemical reaction to produce the dual effect of driving a piston down in order to open the valve arrangement and permit the flow of compressed air, and also acting as a timer mechanism.

It is a yet further object of the present invention to provide a paint ball grenade having reed valves associated with the ejection of the paint balls so that after the initial blast of compressed air to eject each paint ball, the reed valve associated therewith is closed, thereby preventing the rapid escape of unused compressed gas.

It is another object of the present invention to provide a paint ball grenade that is easy and economical to use and manufacture.

In accordance with an aspect of the present invention, a paint ball grenade includes a base having a chamber for holding a compressed gas, an outer housing mounted on the base, the outer housing including a plurality of guides through which fluid communication is provided between an interior of the outer housing and an exterior of the outer housing, each guide adapted to releasably hold a paint ball, a valve arrangement for blocking fluid communication between the chamber and the interior of the housing in a first position and for permitting fluid communication between the chamber and the interior of the housing in a second position, and an actuator for opening the valve arrangement to provide fluid communication between the chamber and the interior of the housing such that the paint balls in the guides are ejected from the guides.

The valve arrangement includes a housing having an inlet opening in fluid communication with the chamber, an outlet opening in fluid communication with the interior of the outer housing, and a sealing member movable between the first position in blocking relation between the inlet and outlet openings and the second position out of the blocking relation between the inlet and outlet openings. The housing further includes a bore between the inlet and outlet openings, with the sealing member including a sealing piston slidably mounted in the bore.

The actuator includes a spring member positioned in the bore for biasing the sealing piston out of the bore to the second position. The actuator further includes a restraining abutment for maintaining the sealing member in the first position in blocking relation between the inlet and outlet openings, and a device for moving the restraining abutment such that the sealing member can move to the second position out of the blocking relation between the inlet and outlet openings.

The device for moving the restraining abutment includes a tower mounted on the base and positioned within the outer housing, a rod having one end connected with the restraining abutment, an actuating piston connected with an opposite end of the rod and movably mounted within the tower, and a piston driver for moving the actuating piston in the tower so that the restraining abutment moves with the actuating piston out of blocking relation to the sealing piston such that the sealing piston is biased by the spring member to the second position out of the blocking relation between the inlet and outlet openings.

The piston driver includes a device for mixing two ingredients to form a chemical reaction of an expanding gas to move the actuating piston such that the restraining abutment moves with a time delay with the actuating piston out of the blocking relation to the sealing piston. Preferably, the ingredients are vinegar and baking soda. Specifically, the device for mixing includes a device for breaking containers in the tower which hold one ingredient such that the one ingredient mixes with the other ingredient to form the chemical reaction. In a preferred embodiment, the device for breaking includes an upper closure member for the tower, a rod slidably mounted in the tower, and an enlarged head mounted to an end of the rod in the tower such that slidable movement of the rod crushes the containers between the upper closure member and the enlarged head so as to free the one ingredient from the containers.

In another embodiment, the actuating piston is replaced by a solenoid connected with an opposite end of the rod and mounted within the tower for reciprocally moving the rod so that the restraining abutment moves with the rod out of blocking relation to the sealing piston such that the sealing piston is biased by the spring member to the second position out of the blocking relation between the inlet and outlet openings. In order to remotely actuate the solenoid, a receiver is electrically connected with the solenoid for actuating the solenoid in response to a transmitted signal from a remote location.

In addition, the guides are mounted to an outer surface of the outer housing, and the outer housing includes a plurality of openings in alignment with the guides for providing the fluid communication between the interior of the outer housing and the exterior of the outer housing.

In accordance with another aspect of the present invention, a paint ball grenade includes a supply of compressed gas, an outer housing including a plurality of guides through which fluid communication is provided between an interior of the outer housing and an exterior of the outer housing, each guide adapted to releasably hold a paint ball, an arrangement for supplying the compressed gas from the supply to the outer housing for ejecting the paint balls from the guides, and a valve arrangement separately associated with each guide for substantially preventing further supply of the compressed gas through each guide after the paint ball in the respective guide has been ejected therefrom.

The valve arrangement includes a reed valve associated with an inlet of each guide, the reed valve permitting fluid communication between the supply and the respective guide when a paint ball is positioned in the guide and which substantially prevents the fluid communication between the supply and the respective guide when the paint ball has been ejected from the guide. The valve arrangement further includes a pin connected with each reed valve for biasing the respective reed valve to an open position when a paint ball is positioned in the guide.

In accordance with still another aspect of the present invention, a paint ball grenade includes a base having a chamber for holding a compressed gas, an outer housing mounted on the base, the outer housing including a plurality of guides through which fluid communication is provided between an interior of the outer housing and an exterior of the outer housing, each guide adapted to releasably hold a paint ball, a first valve arrangement for blocking fluid communication between the chamber and the interior of the housing in a first position and for permitting fluid communication between the chamber and the interior of the housing in a second position, an actuator for opening the first valve arrangement to provide fluid communication between the chamber and the interior of the housing such that the paint balls in the guides are ejected from the guides, and a second valve arrangement separately associated with each guide for substantially preventing further supply of the compressed gas through each guide after the paint ball in the respective guide has been ejected therefrom.

The above and other objects, features and advantages of the invention will become readily apparent from the following detailed description thereof which is to be read in connection with the accompanying drawings.

DETAILED DESCRIPTION

Figure 1:
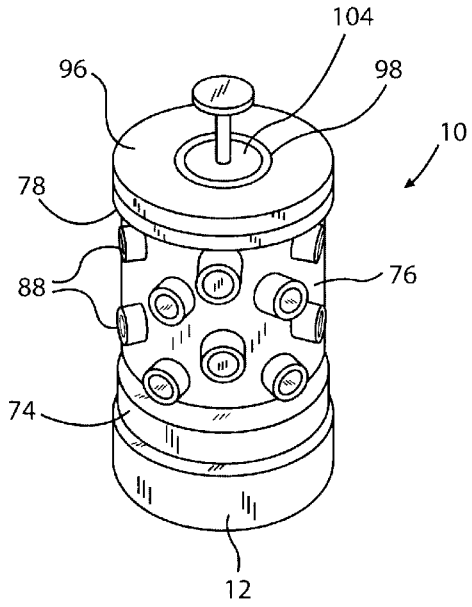
FIG. 1 is a perspective view of a paint ball grenade according to a first embodiment of the present invention.

Referring to the drawings in detail, and initially to FIGS. 1–5, a paint ball grenade 10 according to a first embodiment of the present invention includes a hollow cylindrical base 12 defined by a bottom wall 14, an annular side wall 16 and a top wall 18, which define a chamber 20 therein that can be filled with pressurized or compressed gas or air through a one way valve 22 or the like in bottom wall 14.

Figure 2:
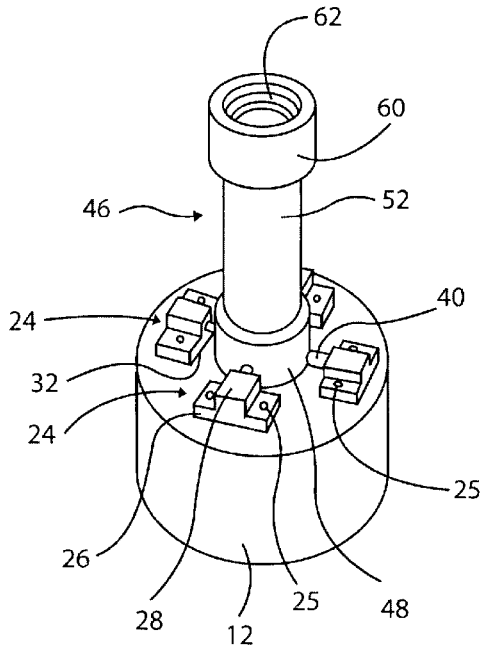
FIG. 2 is a perspective view of the base and tower assembly of the paint ball grenade of FIG. 1.
Figure 4:
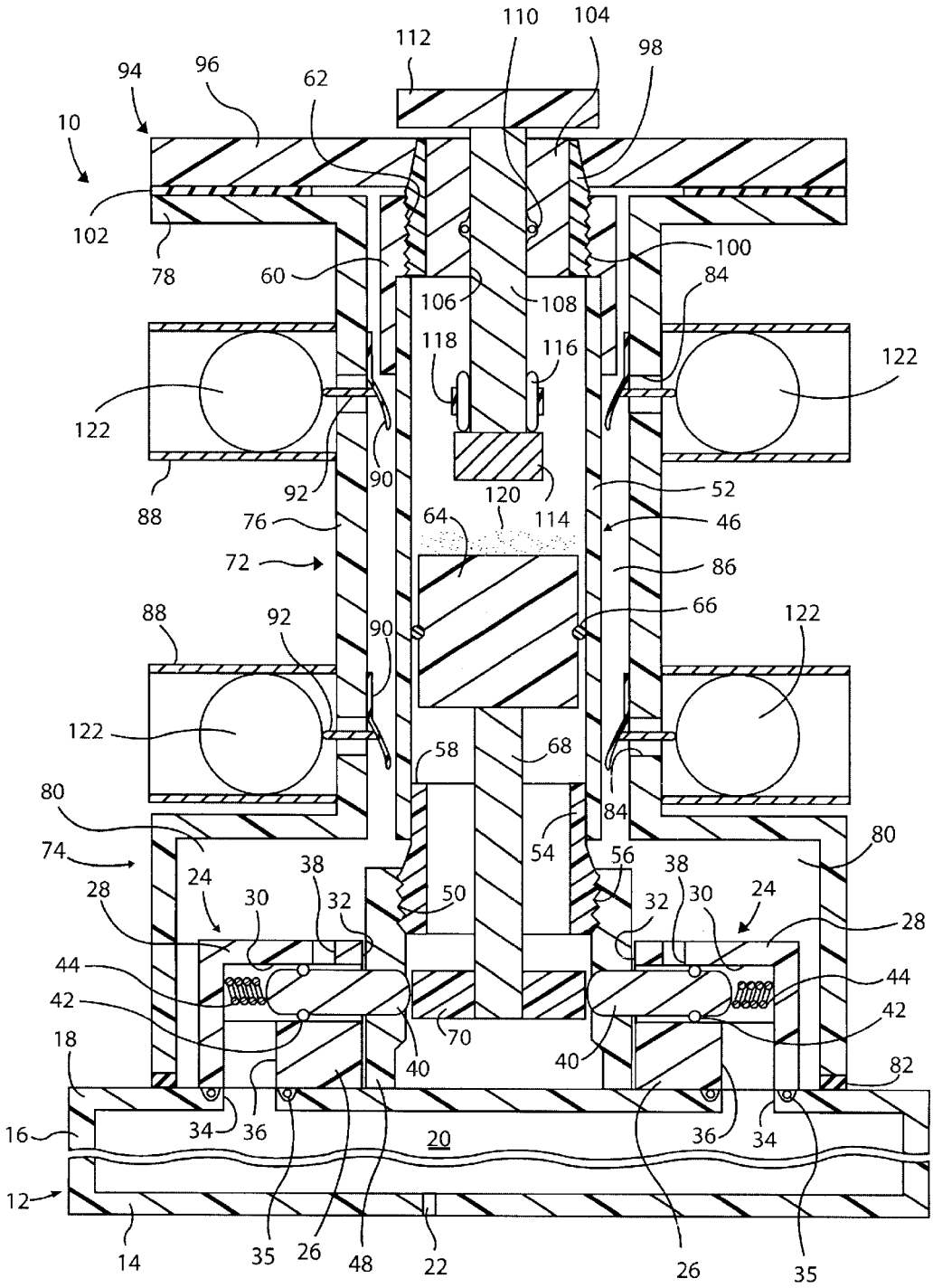
FIG. 4 is a vertical cross-sectional view of the paint ball grenade of FIG. 1, prior to activation.

Four equi-angularly arranged housings 24 sit on the upper surface of top wall 18 of base 12, and are secured thereto by any suitable means such as bolts 25. As best shown in FIGS. 2 and 4, each housing 24 includes a rectangular lower section 26 and a rectangular upper section 28 formed integrally as a single piece with rectangular lower section 26 and formed on top of rectangular lower section 26, with the radially directed dimensions of lower and upper sections 26 and 28 being the same and the tangentially directed dimension of lower section 26 being greater than the tangentially directed dimension of upper section 28, although the present invention is not limited thereby. Bolts 25 extend through lower sections 26. A cylindrical, radially directed bore 30 extends radially outward from the inner facing surface 32 of each housing 24.

As shown best in FIG. 4, top wall 18 includes four openings 34 in alignment with and positioned below each housing 24. An inlet opening 36 in each housing 24 fluidly connects the pressurized air in base 12 with radially directed bore 30, via a respective opening 34. Each housing 24 further includes an outlet opening 38 in the upper surface of upper section 28 which is in fluid communication with bore 30. An O-ring 35 provides a seal between each housing 24 and top wall 18.

In order to prevent the compressed air from escaping from inlet opening 36 to outlet opening 38, a sealing piston 40 is slidably positioned for radial movement in each bore 30. Each sealing piston 40 includes a sealing O-ring 42 near a radially outer end thereof, and which is in sealing engagement with the inner walls which define bore 30. Thus, when piston 40 is in the position shown in FIG. 4, the compressed air is prevented from traveling to outlet opening 38, and when piston 40 is in the position shown in FIG. 5, the compressed air is permitted to travel to outlet opening 38. A coil spring 44 is positioned between the radial outer end of piston 40 and an inner wall which defines bore 30 to normally bias piston 40 toward the radial inward direction to the position of FIG. 5. Bores 30, inlet openings 36, outlet openings 38 and sealing pistons 40 together form a valve arrangement.

A tower 46 is centrally mounted to the upper surface of top wall 18 and is surrounded by housings 24. Specifically, tower 46 includes an annular stub post 48 fixedly secured to the center of the upper surface of top wall 18, and has internal threads 50 at the upper end thereof. An elongated tube 52 has a lower short stub tube 54 secured to the inside of the lower end thereof and extending downwardly, with lower short stub tube 54 having external threads 56 at the lower end thereof for threaded engagement with internal threads 50 in order to releasably secure elongated tube 52 to annular stub post 48. The upper surface of lower short stub tube 54 defines a shoulder 58 that functions as a stop, as will be understood from the description hereinafter. Elongated tube 52 further has an upper short stub tube 60 secured to the outside of the upper end thereof and extending upwardly, with upper short stub tube 60 having internal threads 62 at the upper end.

A piston 64 is slidably provided in the interior of elongated tube 52 and is sealed thereat by an O-ring 66. O-ring 66 forms a friction fit with the inner surface of elongated tube 52 so as to retain piston 64 in one position until an external force is applied thereto. Alternatively, the entire outer surface of piston 64 can be in sliding engagement with the inner surface of elongated tube 52 and sealed thereby. In such case, piston 64 could be made from a rubber or other sealing material. A piston rod 68 has one end connected to piston 64 and the opposite end to a restraining abutment 70 which is initially positioned in line with sealing pistons 40 such that the radially inner ends of sealing pistons 40 are biased by coil springs 44 into engagement with restraining abutment 70, as shown in FIG. 4. In this position, sealing pistons 40 and O-rings 42 prevent the compressed air in base 12 from escaping through outlet openings 38. The outer periphery of restraining abutment 70 can take any shape such as circular, square or the like.

Figure 5:
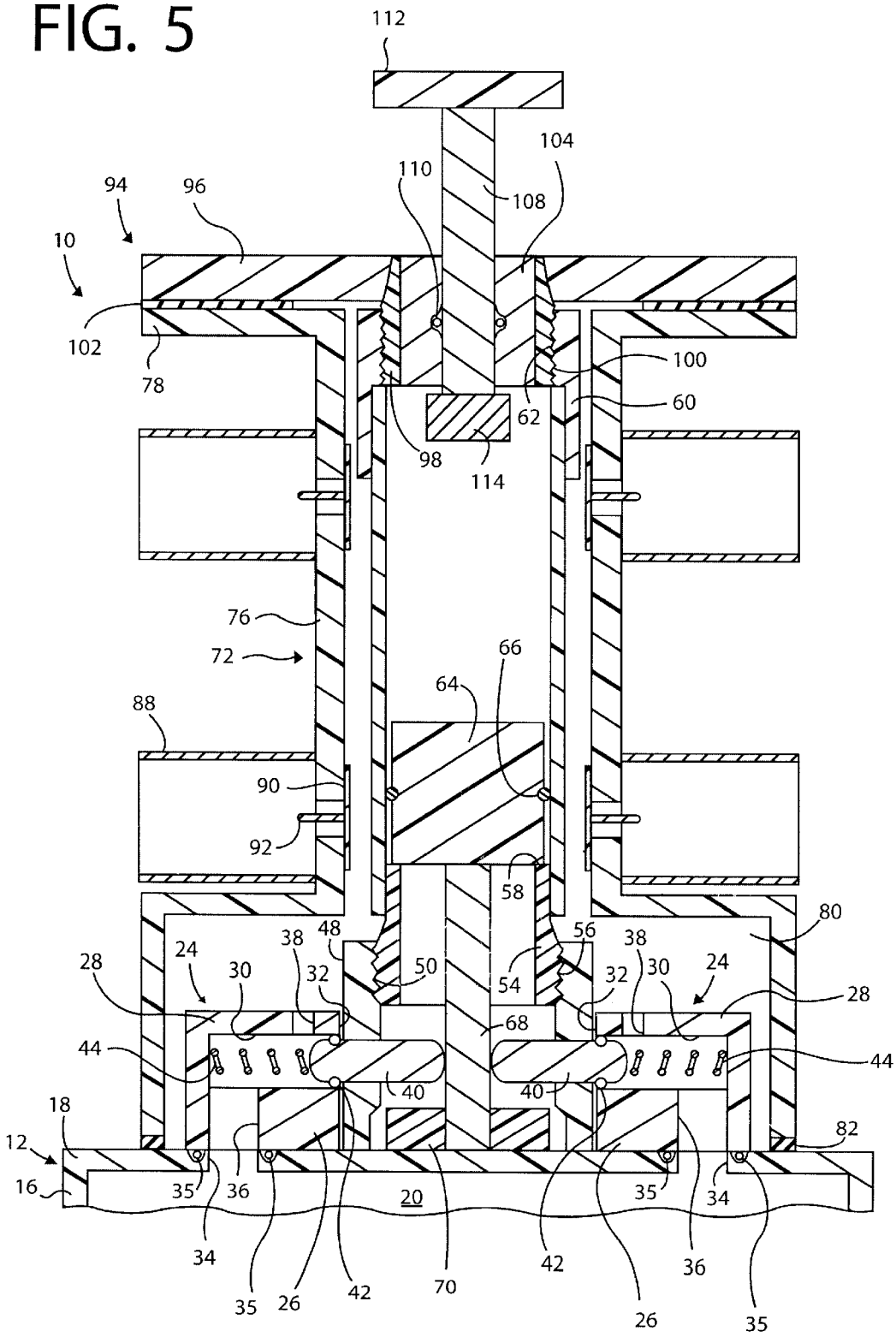
FIG. 5 is a vertical cross-sectional view of the paint ball grenade of FIG. 1, after activation.

It will be appreciated that, when piston 64 moves downwardly, restraining abutment 70 also moves downwardly therewith, out of alignment with sealing pistons 40. As a result, coil springs 44 force sealing pistons 40 in a radial inward direction out of blocking relation to outlet openings 38 and preferably into engagement with piston rod 68, as shown in FIG. 5, so that the compressed air in base 12 is permitted to pass very quickly through openings 34, inlet openings 36, bores 30 and outlet openings 38.

An annular outer housing 72 is provided in surrounding relation to tower 46. Outer housing 72 includes a lower housing section 74 which seats on the upper surface of top wall 18, an annular wall 76 connected to the upper end of lower housing section 74 and an upper annular flange 78 connected to the upper end of annular wall 76.

Figure 3:
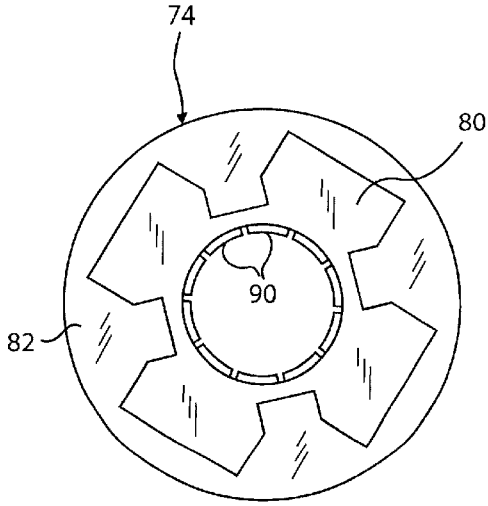
FIG. 3 is a bottom view of the annular outer housing of the paint ball grenade of FIG. 1.

Lower housing section 74, as best shown in FIGS. 3 and 4, is cut away at the bottom thereof to define open areas 80 which receive housings 24 when annular outer housing 72 seats on base 12. A thin rubber sealing layer 82 is secured to the lower surface of lower housing section 74 to provide a seal between lower housing section 74 and the upper surface of top wall 18 of base 12.

Annular wall 76 includes a plurality of radially directed openings 84. Preferably, there are about fourteen to twenty openings 84. Openings 84 are also preferably arranged in a plurality of columns extending around annular wall 76, with two axially spaced apart openings 84 in each column, and with openings 84 in adjacent columns being axially offset from each other. However, the present invention is not so limited, and the number and positioning of openings 84 can vary within the scope of the present invention.

An annular passageway 86 exists between annular wall 76 and tower 46. In this manner, the compressed air travels through outlet openings 38 into passageway 86, and then out through openings 84 in order to eject paint balls, as will be explained in greater detail hereinafter.

A plurality of cylindrical paint ball retaining guides 88 are radially mounted to the outer surface of annular wall 76 in alignment with openings 84. Because of the offset of openings 84, guides 88 are likewise offset in the same manner, as shown in FIG. 1. A flexible reed valve 90 of rubber, plastic, metal or other suitable material has one end mounted to the inner surface of annular wall 76 in covering relation to each opening 84. Reed valve 90 can be constructed to be normally pre-biased to a position to close the respective opening 84, although this is not required by the present invention. As shown in FIG. 4, each reed valve 90 can be moved in a radially inward direction so as to provide fluid communication between the respective opening 84 and passageway 86. Although reed valves 90 are shown attached at only one end, reed valves 90 can be attached at opposite ends on opposite sides of openings 84 so that only the middle portion of each reed valve 90 moves in a radially inward direction. A pin 92 is secured to the radially directed outer surface of each reed valve 90 and extends through the respective opening 84 and partially within the respective guide 88.

In order to move piston 64 downwardly and also to seal the upper end of passageway 86, an actuator/seal assembly 94 is threadedly engaged at the upper end of tower 46. Specifically, an annular disk 96 is mounted on the upper end of a short stub tube 98 having external threads 100 that threadedly engage with internal threads 62 of upper short stub tube 60. Annular disk 96 preferably has the same outer diameter as annular wall 76. A rubber sealing layer 102 is provided on the underside of annular disk 96 so as to provide an air-tight seal between annular wall 76 and annular disk 96.

An annular guide 104 is fixedly mounted within short stub tube 98 and has a central axial bore 106. A rod 108 slidably extends through central axial bore 106 and is sealed by an O-ring 110 thereat. An enlarged grasping head 112 is mounted to the upper end of rod 108 for grasping the same in order to move rod 108 in an axial direction of paint ball grenade 10. A nut 114 is threaded to the lower end of rod 108.

A plurality of small glass ampules 116 are held by a rubber band 118 or the like around the lower end of rod 108 so as to seat on nut 114. Ampules 116 preferably include vinegar as a first ingredient. Baking soda 120 or the like is set within tower 46 as a second ingredient, so as to rest on the upper surface of piston 64.

In operation, one paint ball 122 is inserted in each guide 88 such that the paint balls 122 engage the respective pins 92 and push the same inwardly, thereby opening reed valves 90, that is, moving reed valves 90 in a radially inward direction, as shown in FIG. 4. The force necessary to move pins 92 inwardly will not rupture or compromise the structure of paint balls 122. Because of the slight friction fit of paint balls 122 in guides 88, paint balls 122 stay in position and reed valves 90 remain open. Then, enlarged grasping head 112 is grasped and pulled up, whereby rod 108 is pulled up therewith. As a result, ampules 116 are trapped between annular guide 104 and nut 114. Upon continued movement of rod 108, ampules 116 are crushed between these two elements, thereby releasing the vinegar, which mixes with baking soda 120. This causes a chemical reaction with expanding carbon dioxide gas that pushes piston 64 downwardly. Since it takes some time for the vinegar to mix with the baking soda and cause this reaction to move piston 64 down, for example, from three to five seconds, this effectively forms a timer for grenade 10.

As described above, when piston 64 moves down, restraining abutment 70 also moves down therewith, thereby releasing sealing pistons 40, as shown in FIG. 5, which are caused to move inwardly by springs 44. In this position, the compressed air in base 12 passes very quickly through openings 34, inlet openings 36, bores 30 and outlet openings 38, into passageway 86. Initially, the compressed air exits very fast through openings 84 to push out and fire paint balls 122 from guides 8. However, after the first paint ball 122 is fired, the resistance provided by that paint ball 122 no longer exists so that the compressed air would quickly exit out of the guide 88 from which the first paint ball 122 was fired, since this is the path of least resistance. However, after each paint ball 122 is fired, the respective pins 92 are no longer restrained, so that the compressed air then forces the respective reed valves 90 to the closed position of FIG. 5, thus sealing the respective openings 84. In this manner, the remaining compressed air is still used to fire the other paint balls 122.

As a result of this operation, a plurality of paint balls 122 are simultaneously fired from paint ball grenade 10 after a time delay. For example, a person can pull enlarged grasping head 112 and throw paint grenade 10 toward a group of people, whereupon paint balls 122 will simultaneously be fired.

Figure 6:
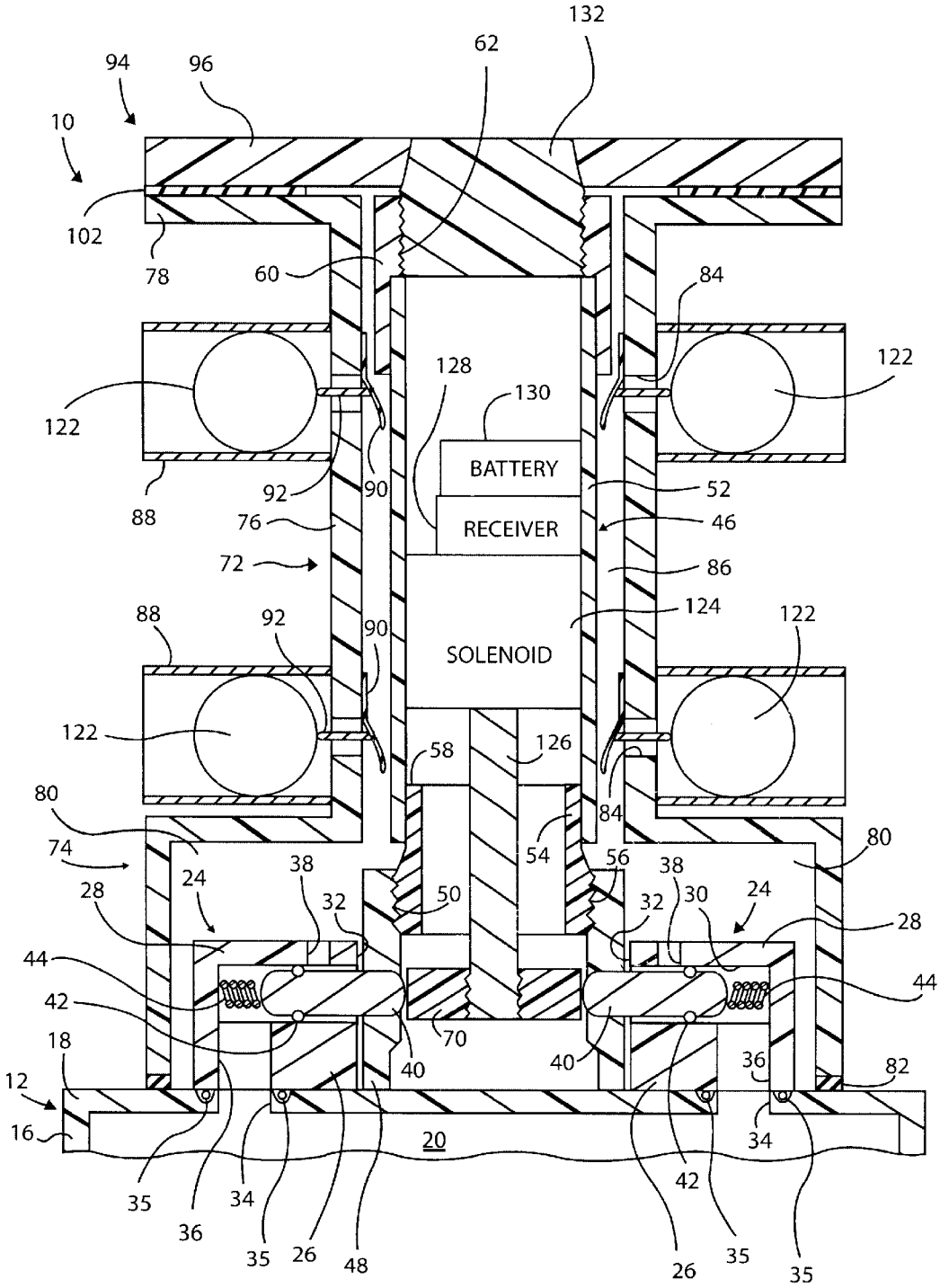
FIG. 6 is a vertical cross-sectional view of a paint ball grenade according to another embodiment of the present invention.

It will be appreciated that other activating devices can be used with the present invention. For example, as shown in FIG. 6, in place of the chemical reaction of the first embodiment, a solenoid 124 is mounted within elongated tube 52 and includes a reciprocally mounted rod 126 in place of piston rod 68. A receiver 128 is also provided in elongated tube 52 for receiving an actuating signal and for actuating solenoid 124 in response thereto. A battery 130 is also positioned in elongated tube 52 for powering solenoid 124 and receiver 128. Because of this arrangement, rod 108, enlarged grasping head 112 and nut 114 are eliminated. Also, short stub tube 98 and annular guide 104 are replaced by a combined c closure member 132.

Alternatively, a remote control device can be hard wired to solenoid 124 to activate the same, thereby eliminating receiver 128.

With this embodiment, a user can position paint ball grenade 10 at a remote location, wait for a group of people to arrive and then, by remote transmitter, transmit an actuating signal to paint ball grenade 10, which is received by receiver 128. Accordingly, solenoid 124 reciprocates rod 126 to the position shown in FIG. 5 with the same result.

Of course, it will be appreciated that paint ball grenade 10 is a one-time use device, since it must be reset and loaded with compressed air after each use. In such case, after paint balls 122 have been fired, actuator/seal assembly 94 is removed by disengaging short stub tube 98 from upper short stub tube 60. Then, lower short stub tube 54 in FIG. 4 is disengaged from annular stub post 48, thereby providing access whereby sealing pistons 40 can be moved radially outward and restraining abutment 70 can be moved back to the position shown in FIG. 4. Alternatively, bolts 25 can be removed in order to remove housings 24, and thereby remove sealing pistons 40 in order to reposition restraining abutment 70. Then, the aforementioned elements of housings 24, sealing pistons 40 and tower 46 are reset. New baking soda 120 is provided on the upper surface of piston 64. New ampules 116 are secured about rod 108, and actuator/seal assembly 94 is secured to tower 46. With this arrangement, paint ball grenade 10 is ready for use again.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A paint ball grenade comprising:

a base having a chamber for holding a compressed gas, an outer housing mounted on said base, said outer housing including a plurality of guides for releasably holding paint balls and through which fluid communication is provided between an interior of said outer housing and an exterior of said outer housing, a valve arrangement for blocking fluid communication between said chamber and said interior of said housing in a first position and for permitting fluid communication between said chamber and said interior of said housing in a second position, said valve arrangement including:

an inlet opening in fluid communication with said chamber, an outlet opening in fluid communication with said interior of said outer housing, and a sealing member movable between said first position in blocking relation between said inlet and outlet openings and said second position out of said blocking relation between said inlet and outlet openings, said outer housing further includes a bore between said inlet and outlet openings, with said sealing member including a sealing piston slidably mounted in said bore, and further comprising an actuator for opening said valve arrangement to provide fluid communication between said chamber and said interior of said housing such that paint balls in said guides are ejected from said guides, said actuator including:

a spring member positioned in said bore for biasing said sealing piston out of said bore to the second position, and a restraining abutment for maintaining said sealing member in said first position in blocking relation between said inlet and outlet openings.

2. A paint ball grenade according to claim 1, wherein said actuator includes:

a device for moving said restraining abutment such that said sealing member can move to said second position out of said blocking relation between said inlet and outlet openings.

3. A paint ball grenade according to claim 2, wherein said device for moving said restraining abutment includes:

a tower mounted on said base and positioned within said outer housing, a rod having one end connected with said restraining abutment, an actuating piston connected with an opposite end of said rod and movably mounted within said tower, and a piston driver for moving said actuating piston in said tower so that said restraining abutment moves with said actuating piston out of blocking relation to said sealing piston such that said sealing piston is biased by said spring member to said second position out of said blocking relation between said inlet and outlet openings.

4. A paint ball grenade according to claim 3, wherein said piston driver includes a device for mixing two ingredients to form a chemical reaction of an expanding gas to move said actuating piston such that said restraining abutment moves with a time delay with said actuating piston out of said blocking relation to said sealing piston.

5. A paint ball grenade according to claim 4, wherein said ingredients are vinegar and baking soda.

6. A paint ball grenade according to claim 4, wherein said device for mixing includes a device for breaking containers in said tower which hold one said ingredient such that said one ingredient mixes with she other ingredient to form said chemical reaction.

7. A paint ball grenade according to claim 6, wherein said device for breaking includes:

an upper closure member for said tower, a rod slidably mounted in said tower, and an enlarged head mounted to an end of said rod in said tower such that slidable movement of said rod crushes said containers between said upper closure member and said enlarged head so as to free said one ingredient from said containers.

8. A paint ball grenade according to claim 2, wherein said device for moving said restraining abutment includes:

a tower mounted on said base and positioned within said outer housing;

a rod having one end connected with said restraining abutment, and a solenoid connected with an opposite end of said rod and mounted within said tower for reciprocally moving said rod so that said restraining abutment moves with said rod out of blocking relation to said sealing piston such that said sealing piston is biased by said spring member to said second position out of said blocking relation between said inlet and outlet openings.

9. A paint ball grenade according to claim 8, further including a receiver electrically connected with said solenoid for actuating said solenoid in response to a transmitted signal from a remote location.

10. A paint ball grenade according to claim 1, wherein said guides are mounted to an outer surface of said outer housing, and said outer housing includes a plurality of openings in alignment with said guides for providing said fluid communication between the interior of said outer housing and the exterior of said outer housing.

11. A paint ball grenade comprising:

a base having a chamber for holding a compressed gas, an outer housing mounted on said base, said outer housing including a plurality of guides for releasably holding paint balls and through which fluid communication is provided between an interior of said outer housing and an exterior of said outer housing, a valve arrangement for blocking fluid communication between said chamber and said interior of said housing in a first position and for permitting fluid communication between said chamber and said interior of said housing in a second position, and an actuator for opening said valve arrangement to provide fluid communication between said chamber and said interior of said housing such that said paint balls in said guides are ejected from said guides, said actuator including:

a movable driver for controlling opening and closing of said valve arrangement; and a device for mixing two ingredients to form a chemical reaction of an expanding gas to control movement of said driver to open said valve arrangement with a time delay.

12. A paint ball grenade comprising:

a supply of compressed gas, an outer housing including a plurality of guides for releasably holding paint balls and through which fluid communication is provided between an interior of said outer housing and an exterior of said outer housing, an arrangement for supplying said compressed gas from said supply to said outer housing for ejecting paint balls from said guides, and a valve arrangement separately associated with each guide for substantially preventing further supply of said compressed gas through each guide after the paint ball in the respective guide has been ejected therefrom.

13. A paint ball grenade according to claim 12, wherein said valve arrangement includes a reed valve associated with an inlet of each said guide, said reed valve permitting fluid communication between said supply and the respective guide when a paint ball is positioned in said guide and which substantially prevents said fluid communication between said supply and the respective guide when the paint ball has been ejected from said guide.

14. A paint ball grenade according to claim 13, wherein said valve arrangement further includes a pin connected with each said reed valve for biasing the respective reed valve to an open position when a paint ball is positioned in said guide.

15. A paint ball grenade comprising:

a base having a chamber for holding a compressed gas, an outer housing mounted on said base, said outer housing including a plurality of guides for releasably holding paint balls and through which fluid communication is provided between an interior of said outer housing and an exterior of said outer housing, a first valve arrangement for blocking fluid communication between said chamber and said interior of said housing in a first position and for permitting fluid communication between said chamber and said interior of said housing in a second position, an actuator for opening said first valve arrangement to provide fluid communication between said chamber and said interior of said housing such that paint balls in said guides are ejected from said guides, and a second valve arrangement separately associated with each guide for substantially preventing further supply of said compressed gas through each guide after the paint ball in the respective guide has been ejected therefrom.

16. A paint ball grenade according to claim 15, wherein said first valve arrangement includes a housing having:

an inlet opening in fluid communication with said chamber, an outlet opening in fluid communication with said interior of said outer housing, a bore between said inlet and outlet openings, and a sealing piston slidably mounted in said bore for movement between said first position in blocking relation between said inlet and outlet openings and said second position out of said blocking relation between said inlet and outlet openings.

17. A paint ball grenade according to claim 16, wherein said actuator includes:

a spring member position in said bore for biasing said sealing piston out of said bore, a restraining abutment for maintaining said sealing piston in said first position in blocking relation between said inlet and outlet openings, a tower mounted on said base and positioned within said outer housing;

a rod having one end connected with said restraining abutment, an actuating piston connected with an opposite end of said rod and movably mounted within said tower, and a piston driver for moving said actuating piston in said tower so that said restraining abutment moves with said actuating piston out of blocking relation to said sealing piston such that said sealing piston is biased by said spring member to said second position out of said blocking relation between said inlet and outlet openings.

18. A paint ball grenade according to claim 17, wherein said piston driver includes a device for mixing two ingredients to form a chemical reaction of an expanding gas to move said actuating piston such that said restraining abutment moves with a time delay with said actuating piston out of said blocking relation to said sealing piston.

19. A paint ball grenade according to claim 18, wherein said device for mixing includes a device for breaking containers in said tower which hold one said ingredient such that said one ingredient mixes with the other ingredient to form said chemical reaction.

20. A paint ball grenade according to claim 16, wherein said actuator includes:

a spring member position in the bore for biasing the sealing piston out of the bore;

a restraining abutment for maintaining said sealing piston in said first position in blocking relation between said inlet and outlet openings, a tower mounted on said base and positioned within said outer housing;

a rod having one end connected with said restraining abutment, and a solenoid connected with an opposite end of said rod and mounted within said tower for reciprocally moving said rod so that said restraining abutment moves with said rod out of blocking relation to said sealing piston such that said sealing piston is biased by said spring member to said second position out of said blocking relation between said inlet and outlet openings.

21. A paint ball grenade according to claim 20, further including a receiver electrically connected with said solenoid for actuating said solenoid in response to a transmitted signal from a remote location.

22. A paint ball grenade according to claim 15, wherein said guides are mounted to an outer surface of said outer housing, and said outer housing includes a plurality of openings in alignment with said guides for providing said fluid communication between the interior of said outer housing and the exterior of said outer housing.

23. A paint ball grenade according to claim 22, wherein said second valve arrangement includes a reed valve associated with each said opening of said outer housing, said reed valve permitting fluid communication between said chamber and the respective opening in said outer housing when a paint ball is positioned in said guide and which substantially prevents said fluid communication between said chamber and the respective opening in said outer housing when the paint ball has been ejected from said guide.

24. A paint ball grenade according to claim 23, wherein said second valve arrangement further includes a pin connected with each said reed valve for biasing the respective reed valve to an open position when a paint ball is positioned in said guide.

* * * * *